US011640129B2

(12) United States Patent
Maruyama et al.

(10) Patent No.: US 11,640,129 B2
(45) Date of Patent: May 2, 2023

(54) HEATING UNIT

(71) Applicant: Brother Kogyo Kabushiki Kaisha, Nagoya (JP)

(72) Inventors: Yasuhiro Maruyama, Nagoya (JP); Makoto Souda, Nagoya (JP); Yuichi Ikeno, Maibara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/574,866

(22) Filed: Jan. 13, 2022

(65) Prior Publication Data

US 2022/0229386 A1 Jul. 21, 2022

(30) Foreign Application Priority Data

Jan. 15, 2021 (JP) ..... JP2021-004688

(51) Int. Cl.
*G03G 15/20* (2006.01)
*H05B 3/14* (2006.01)

(52) U.S. Cl.
CPC ..... *G03G 15/2053* (2013.01); *G03G 15/2017* (2013.01); *G03G 15/2039* (2013.01); *H05B 3/141* (2013.01); *G03G 2215/2035* (2013.01)

(58) Field of Classification Search
CPC ..... G03G 15/2017; G03G 15/2039; G03G 15/2053; G03G 2215/2035; G03G 2215/2038; H05B 3/141
USPC ..... 399/69, 329
See application file for complete search history.

(56) References Cited

U.S. PATENT DOCUMENTS

| | | | | |
|---|---|---|---|---|
| 10,268,145 | B2 * | 4/2019 | Ando | G03G 15/205 |
| 2014/0138372 | A1 | 5/2014 | Ogura | |
| 2015/0227091 | A1 | 8/2015 | Ando et al. | |
| 2020/0033774 | A1 * | 1/2020 | Shinji | G03G 15/2053 |
| 2021/0063926 | A1 * | 3/2021 | Saeki | G03G 15/2053 |
| 2022/0229387 | A1 * | 7/2022 | Maruyama | G03G 15/2053 |

FOREIGN PATENT DOCUMENTS

| | | | |
|---|---|---|---|
| JP | 2014-102429 | A | 6/2014 |
| JP | 2014-123100 | A | 7/2014 |
| JP | 2017-194719 | A | 10/2017 |
| JP | 2019-056810 | A | 4/2019 |

* cited by examiner

*Primary Examiner* — Robert B Beatty
(74) *Attorney, Agent, or Firm* — Burr Patent Law, PLLC

(57) ABSTRACT

A heating unit includes a heater, a temperature sensor, an endless belt, a holder, a first heat conductive member, and a second heat conductive member. The first heat conductive member includes a first heater-side surface facing the heater, a first opposite surface, and an opening. The first heat conductive member has a heat conductivity higher than that of the substrate. The second heat conductive member includes a second heater-side surface facing the heater and a second opposite surface. The second heat conductive member is positioned at a position corresponding to the opening when viewed in an orthogonal direction orthogonal to the first opposite surface. The temperature sensor is in contact with the second opposite surface of the second heat conductive member.

20 Claims, 10 Drawing Sheets

HEATING UNIT

CROSS REFERENCE TO RELATED APPLICATION

The present application claims priority from Japanese Patent Application No. 2021-004688, which was filed on Jan. 15, 2021, the disclosure of which is herein incorporated by reference in its entirety.

BACKGROUND

The following disclosure relates to a heating unit used for a fixing device of an electrophotographic type image forming apparatus or the like.

In the past, there has been known a fixing device in which a rotating belt is interposed between a ceramic heater and a pressure roller. In the fixing device, the ceramic heater includes a substrate and a resistance heating element, in which a sheet-shaped heat conductive member is disposed so as to be in contact with a back surface located on an opposite side of a nip surface which is in contact with the belt. A through hole is formed in the heat conductive member, and a temperature detecting member is in contact with the back surface of the ceramic heater through the through hole.

SUMMARY

Incidentally, in a case where the heater is configured such that the resistance heating element is provided on the substrate, a temperature difference occurs between a portion of the heater near to the resistance heating element and a portion of the heater apart from the resistance heating element. Accordingly, when the temperature detecting member is directly brought into contact with the back surface of the heater as in the related-art technique, it may be difficult to detect an accurate temperature due to unevenness in temperature caused by disposition of the resistance heating element.

In view of the above, an object of the present disclosure is to detect the accurate temperature by the temperature detecting member.

In one aspect of the disclosure, a heating unit includes a heater including a substrate and a resistance heating element provided on the substrate, a temperature sensor configured to detect a temperature of the heater, an endless belt configured to rotate around the heater, a holder supporting the heater, a first heat conductive member located between the heater and the holder, the first heat conductive member including a first heater-side surface facing the heater, a first opposite surface located on an opposite side of the first heater-side surface, and an opening, the first heat conductive member having a heat conductivity higher than that of the substrate, and a second heat conductive member disposed at a position at least corresponding to the opening when viewed in an orthogonal direction orthogonal to the first opposite surface, the second heat conductive member including a second heater-side surface facing the heater and a second opposite surface located on an opposite side of the second heater-side surface. The temperature sensor is in contact with the second opposite surface of the second heat conductive member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
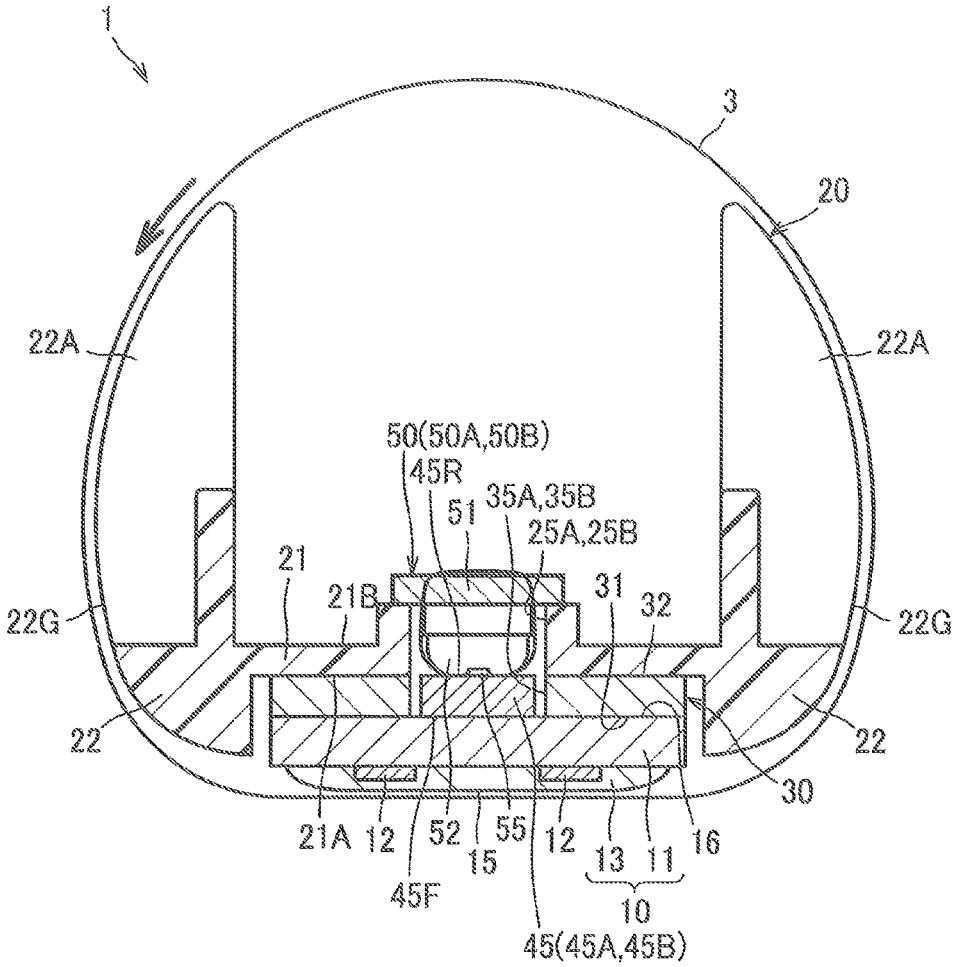
FIG. 1 is a cross-sectional view of a heating unit at a position of a thermistor.

A heating unit 1 according to an embodiment is used for a fixing device of an image forming apparatus, or a device that transfers foil by heat, and the like. As illustrated in FIG. 1, the heating unit 1 includes a belt 3, a heater 10, a holder 20, a first heat conductive member 30, second heat conductive members 45, 46 (see FIG. 4), a thermistor 50 as an example of a temperature sensor, and an energization interrupting member 60 as another example of the temperature sensor (see FIG. 4).

The belt 3 is an endless belt, which is made of metal or resin. The belt 3 rotates around the heater 10 while being guided by the holder 20. The belt 3 has an outer circumferential surface and an inner circumferential surface. The outer circumferential surface comes into contact with a sheet to be heated. The inner circumferential surface is in contact with the heater 10.

Figure 2A:
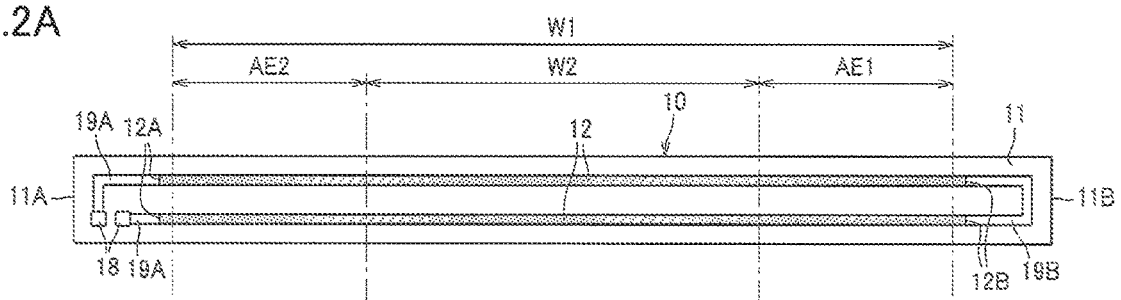
FIG. 2A is a view illustrating a surface on which resistance heating elements of a heater are disposed.

The heater 10 includes a substrate 11, resistance heating elements 12 provided on the substrate 11, and a cover 13. The substrate 11 is formed of a long rectangular plate made of ceramic. The heater 10 is a so-called ceramic heater. The resistance heating elements 12 are formed on one surface of the substrate 11 by printing. As illustrated in FIG. 2A, two resistance heating elements 12 are provided in the embodiment. The two resistance heating elements 12 are respectively disposed so as to extend in a longitudinal direction of the heater 10 (hereinafter the longitudinal direction of the heater 10 is referred to merely as a "longitudinal direction") and so as to be spaced apart from each other in parallel in a short-side direction orthogonal to the longitudinal direction. A conducting wire 19A is connected to one end 12A of each of the resistance heating elements 12, and a terminal 18 for supplying power is provided at an end portion of the conducting wire 19A of each of the resistance heating elements 12. The other ends 12B of the resistance heating elements 12 are connected to each other by a conducting wire 19B. The number of resistance heating elements 12 is not particularly limited. The resistance heating elements may be configured such that a resistance heating element in which a heat generation amount at the center in the longitudinal direction is higher than a heat generation amount at end portions in the longitudinal direction and a resistance heating element in which the heat generation amount at end portions in the longitudinal direction is higher than the heat generation amount at the center in the longitudinal direction are provided, and such that a heat generation distribution in the longitudinal direction is regulated by individually controlling each of the resistance heating elements.

The cover 13 covers the resistance heating elements 12. The cover 13 is made of, for example, glass. The heater 10 includes a nip surface 15 which is in contact with the inner circumferential surface of the belt 3 and a back surface 16 located on an opposite side of the nip surface 15.

The holder 20 is a member supporting the heater 10. The holder 20 includes a support portion 21 and guide portions 22. The support portion 21 has a plate shape corresponding to the shape of the heater 10. The support portion 21 includes a support surface 21A which is a surface facing the side on which the heater 10 is disposed and an inside surface 21B located on an opposite side of the support surface 21A. As illustrated in FIG. 2C, the support portion 21 has holder openings 25A, 25B, and 26 piercing through the support portion 21. The holder opening 25A is disposed at the center of the support portion 21 in the longitudinal direction, and has a long rectangular shape in the longitudinal direction. The holder opening 26 is disposed at one end portion of the support portion 21 in the longitudinal direction, and has a long rectangular shape in the longitudinal direction. The holder opening 25B is disposed at the other end portion of the support portion 21 in the longitudinal direction, and has a long rectangular shape in the longitudinal direction.

The thermistor 50 includes two thermistors which are a first thermistor 50A and a second thermistor 50B. The first thermistor 50A and the second thermistor 50B are the same components. The first thermistor 50A detects a temperature at the center in the longitudinal direction of the heater 10. The first thermistor 50A is used for controlling the temperature of the heater 10 such that the temperature of the heater 10 becomes a target temperature based on the temperature detected by the first thermistor 50A. The second thermistor 50B detects the temperature of the heater 10 at a position nearer to an end of the heater 10 in the longitudinal direction than the position detected by the first thermistor 50A. The second thermistor 50B is used for detecting that the temperature is increased at the position near to the end of the heater 10. The holder opening 25A is disposed at a position corresponding to the first thermistor 50A. The first thermistor 50A and the second thermistor 50B may not be the same component. In this case, it is preferable that the first thermistor 50A is a member with higher accuracy in temperature detection than the second thermistor 50B in a temperature range during printing operation.

The energization interrupting member 60 is a member configured to interrupt energization to the resistance heating elements 12 when the heater 10 is abnormally increased in temperature. The holder opening 26 is disposed at the position corresponding to the energization interrupting member 60.

Returning to FIG. 1, the guide portions 22 are provided at both ends in a short-side direction of the support portion 21. The short-side direction is a direction orthogonal to the longitudinal direction of the support portion 21. Each of the guide portions 22 includes a guide surface 22G extending along the inner circumferential surface of the belt 3. Each of the guide portions 22 has a plurality of guide ribs 22A arranged in the longitudinal direction as illustrated in FIG. 1 and FIG. 2C.

The first heat conductive member 30 is a member configured to uniformize the temperature of the heater 10 in the longitudinal direction by conducting heat in the longitudinal direction of the heater 10. The first heat conductive member 30 is a sheet-like member, and is located between the heater 10 and the support portion 21 of the holder 20. When the sheet as a heating target is interposed between the heating unit 1 and another pressure member, the first heat conductive member 30 is interposed between the heater 10 and the support portion 21. The first heat conductive member 30 includes a first heater-side surface 31 which is in contact with the back surface 16 of the heater 10 and a first opposite surface 32 located on an opposite side of the first heater-side surface 31. The first opposite surface 32 is in contact with the support surface 21A of the support portion 21.

Figure 2B:
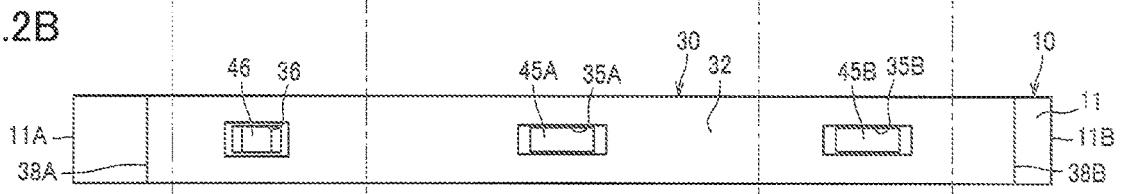
FIG. 2B is a view of the heater, a first heat conductive member, and second heat conductive members viewed from a back side of the heater.
Figure 2C:
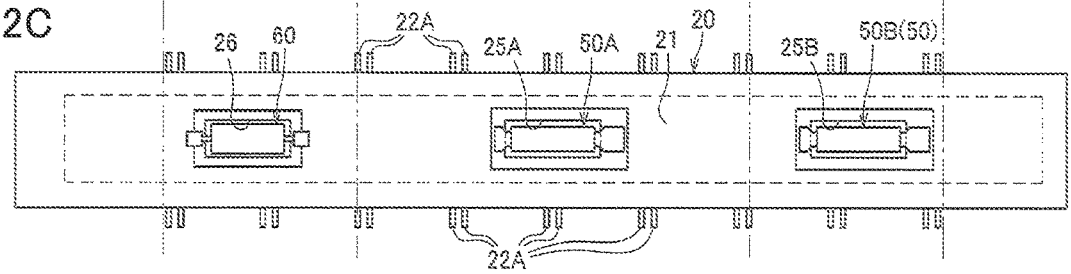
FIG. 2C is a view of a holder viewed from an opposite side of the heater.

As illustrated in FIG. 2B, the first heat conductive member 30 includes first openings 35A, 35B as an example of an opening and a second opening 36 as another example of the opening. The first openings 35A and 35B pierce through the first heat conductive member 30. The first opening 35A is disposed at the center of the first heat conductive member 30 in the longitudinal direction, and has a long rectangular shape in the longitudinal direction. The first opening 35A is disposed at a position corresponding to the holder opening 25A, namely, the position corresponding to the first thermistor 50A.

The second opening 36 is disposed at one end portion of the first heat conductive member 30 in the longitudinal direction, and has a long rectangular shape in the longitudinal direction. The second opening 36 is disposed at a position corresponding to the holder opening 26, namely, the position corresponding to the energization interrupting member 60.

The first opening 35B is disposed at the other end portion of the first heat conductive member 30 in the longitudinal direction, and has a long rectangular shape in the longitudinal direction. The first opening 35B is disposed at a position corresponding to the holder opening 25B, namely, the position corresponding to the second thermistor 50B.

As illustrated in FIG. 1, the first heat conductive member 30 is a member in which a heat conductivity in a direction parallel to the first heater-side surface 31 (hereinafter referred to merely as a "planar direction") is higher than a heat conductivity in the planar direction of the substrate 11. A material of the first heat conductive member 30 is not particularly limited. For example, metals such as aluminum, aluminum alloys, and copper having high heat conductivities can be adopted. The first heat conductive member 30 may be an anisotropic heat conductive member in which the heat conductivity in the planar direction is higher than a heat conductivity in a thickness direction orthogonal to the first heater-side surface 31. For example, a graphite sheet can be adopted as the anisotropic heat conductive member. A thickness of the first heat conductive member 30 is not particularly limited either. For example, a film-like member thinner than 0.1 mm and a plate-like member thicker than 1 mm may be adopted. It is preferable that the thickness of the first heat conductive member 30 is 0.03 mm to 3 mm.

The second heat conductive members 45, 46 are members configured to uniformize the temperature at portions where the second heat conductive members 45, 46 are in contact with the heater 10 by conducting heat in the planar direction and configured to conduct heat from the heater 10 to the temperature sensor (the thermistor 50 or the energization interrupting member 60) quickly.

The second heat conductive member 45 is a sheet-like member, and includes a second heater-side surface 45F facing the heater 10 side and a second opposite surface 45R located on an opposite side of the second heater-side surface 45F.

Figure 4:
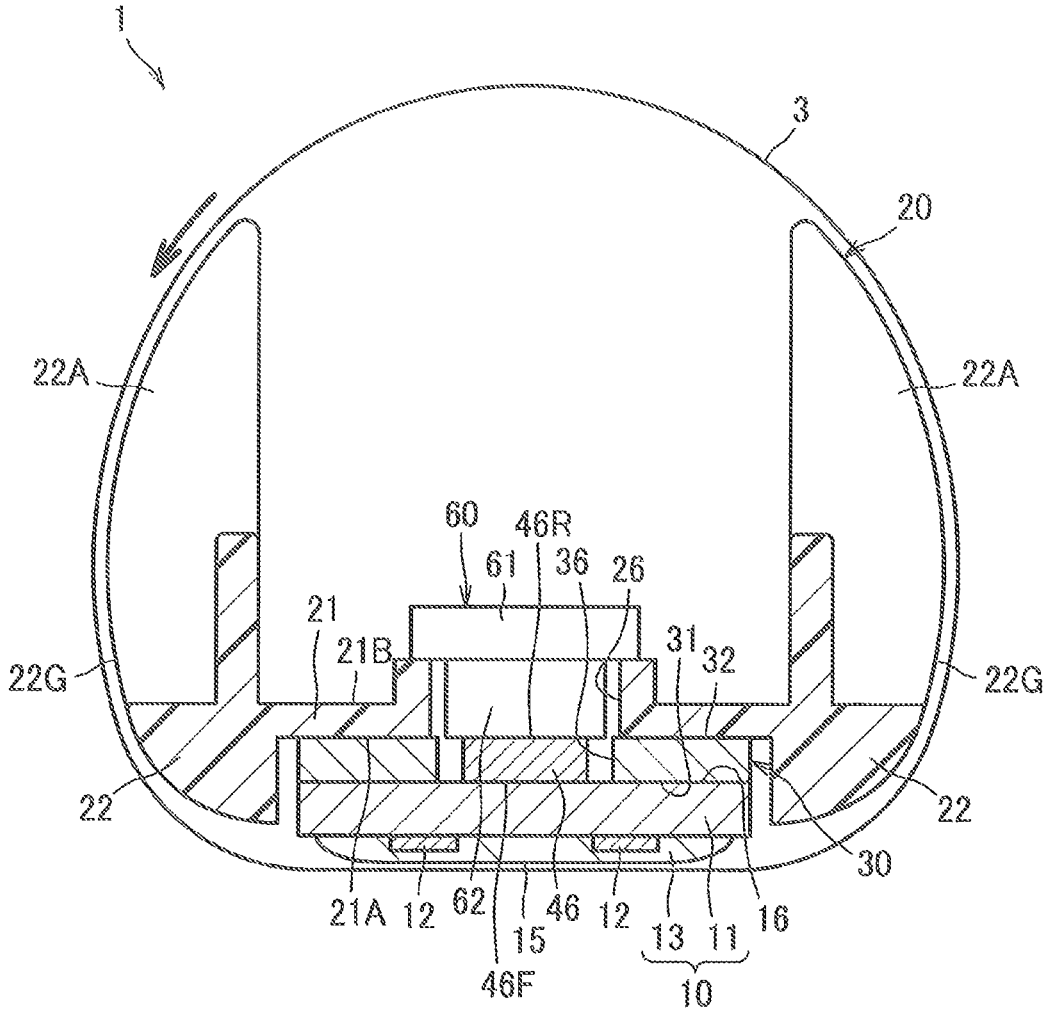
FIG. 4 is a cross-sectional view of the heating unit at a position of the energization interrupting member.

As illustrated in FIG. 4, the second heat conductive member 46 also includes a second heater-side surface 46F facing the heater 10 side and a second opposite surface 46R located on an opposite side of the second heater-side surface 46F in the same manner.

As illustrated in FIG. 1 and FIG. 4, the second heat conductive members 45, 46 are disposed at positions respectively corresponding to the first openings 35A, 35B, and the second opening 36 when viewed in an orthogonal direction orthogonal to the first opposite surface 32 of the first heat conductive member 30. The second heat conductive member 45 includes a second heat conductive member 45A and a second heat conductive member 45B. In the embodiment, the second heat conductive member 45A and the second heat conductive member 45B are the same component while disposed at positions different from each other.

In the embodiment, sizes of the second heat conductive members 45A, 45B, and 46 are smaller than a size of the first heat conductive member 30. Then, the second heat conductive member 45A is located inside the first opening 35A. The second heat conductive member 45B is located inside the first opening 35B. The second heat conductive member 46 is located inside the second opening 36.

The second heat conductive members 45, 46 are members in which a heat conductivity in the planar direction is higher than the heat conductivity in the planar direction of the substrate 11. A material of the second heat conductive members 45, 46 is not particularly limited. For example, metals such as aluminum, aluminum alloys, and copper having high heat conductivities can be adopted. A thickness of each of the second heat conductive members 45, 46 is not particularly limited either. For example, a film-like member thinner than 0.1 mm and a plate-like member thicker than 1 mm may be adopted as the second heat conductive members 45, 46. It is preferable that the thickness of each of the second heat conductive members 45, 46 is 0.03 mm to 3 mm.

Sizes of the second heat conductive members 45, 46 in the short-side direction orthogonal to the longitudinal direction are larger than a size of the resistance heating element 12 in the short-side direction. Then, the second heat conductive members 45, 46 are located between the two resistance heating elements 12 in the short-side direction.

Figure 8:
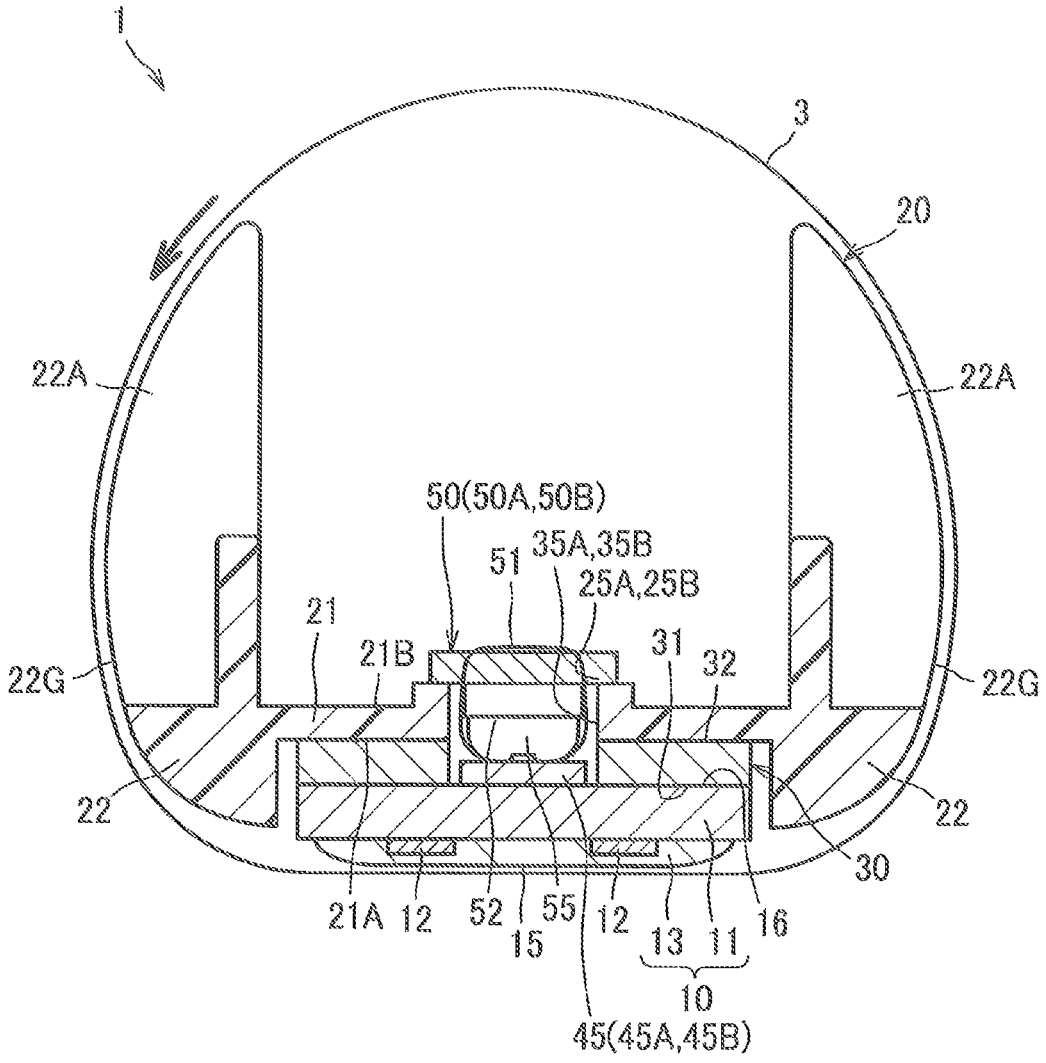
FIG. 8 is a cross-sectional view of a heating unit according to a modification example in a case where the second heat conductive member is thinner than the first heat conductive member.

The second heat conductive members 45, 46 have better heat conductivities at least in the thickness direction than the first heat conductive member 30. Therefore, a heat conductivity from the heater 10 to the second opposite surfaces 45R, 46R is better than a heat conductivity from the heater 10 to the first opposite surface 32. In this case, the good heat conductivity does not mean that a heat conductivity of the material of the second heat conductive members 45, 46 is merely high, but means that heat is conducted quickly including the thickness of the second heat conductive members 45, 46. For example, in a case where the first heat conductive member 30 and the second heat conductive members 45, 46 have the same thickness as illustrated in FIG. 1 and FIG. 4, heat is conducted quickly from the heater 10 to the second opposite surfaces 45R, 46R as compared with from the heater 10 to the first opposite surface 32 when the heat conductivity of the second heat conductive members 45, 46 in the thickness direction is higher than the heat conductivity of the first heat conductive member 30 in the thickness direction. In a case where the first heat conductive member 30 and the second conductive member 45 are formed of the same material and have the same heat conductivity, heat is conducted quickly from the heater 10 to the second opposite surfaces 45R, 46R as compared with from the heater 10 to the first opposite surface 32 when the thickness of the second heat conductive member 45 is smaller than the thickness of the first heat conductive member 30 as in a modification example illustrated in FIG. 8.

Figure 5A:
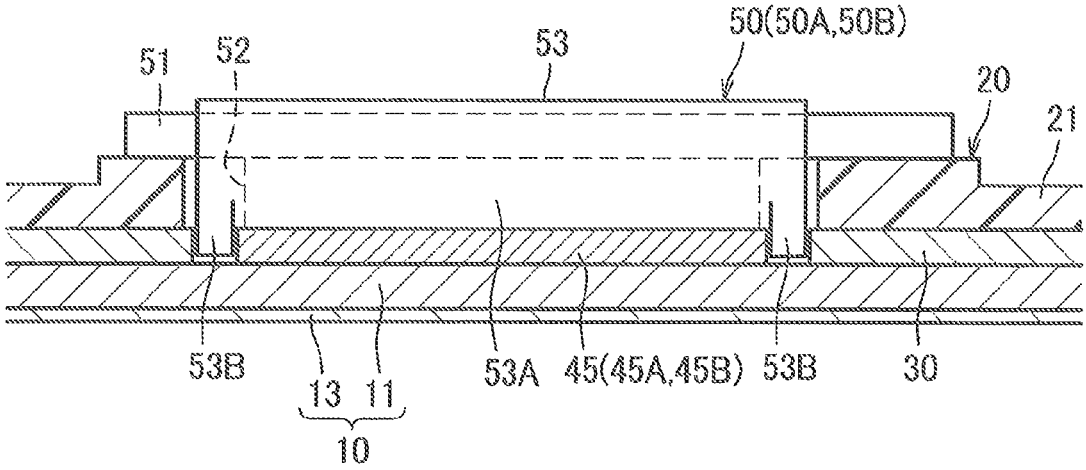
FIG. 5A is a cross-sectional view of the heating unit along a longitudinal direction for explaining positioning of the second heat conductive member and the thermistor.
Figure 5B:
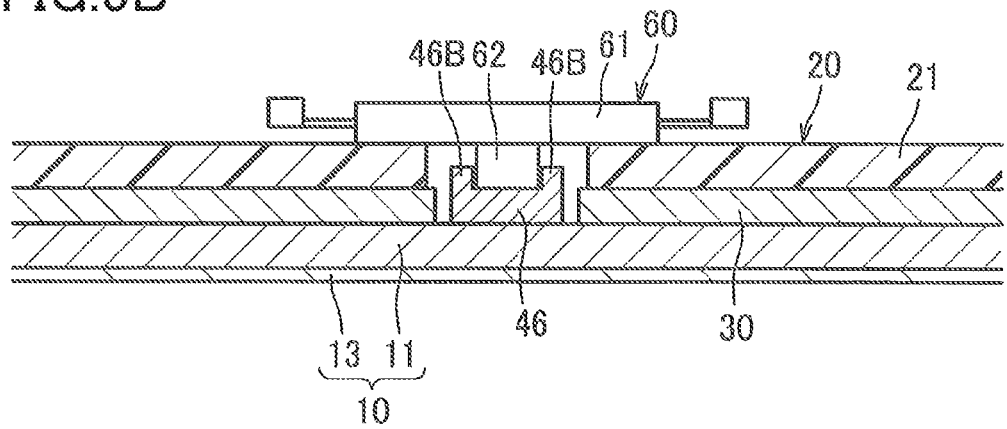
FIG. 5B is a cross-sectional view of the heating unit along the longitudinal direction for explaining positioning of the second heat conductive member and the energization interrupting member.

The second heat conductive member 46 has protruding portions 46B, each of which is an example of a second protrusion, protruding toward the energization interrupting member 60 in the thickness direction as illustrated in FIG. 5B. The protruding portions 46B protrude from end portions in the longitudinal direction of the second heat conductive member 46.

Figure 3A:
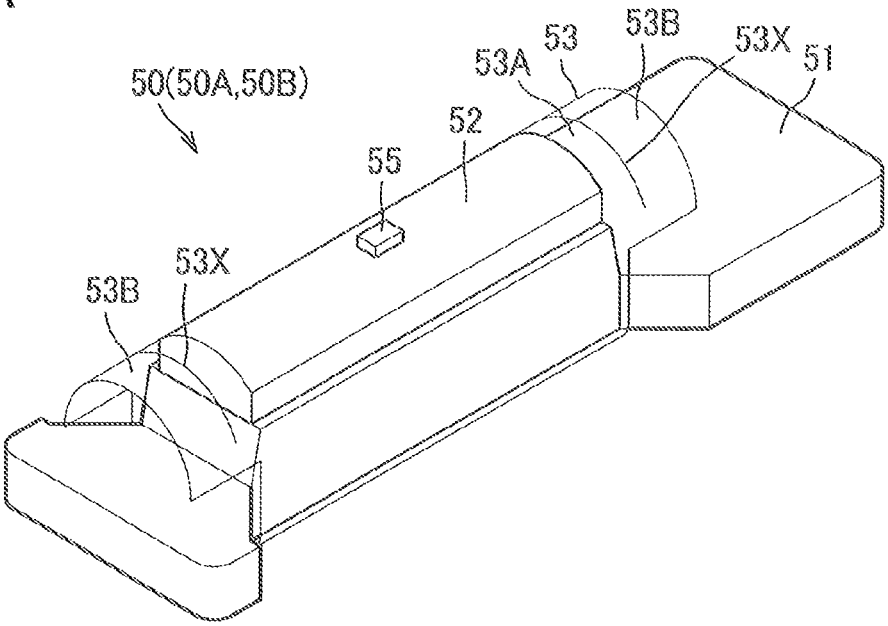
FIG. 3A is a perspective view of the thermistor.

As illustrated in FIG. 3A, the thermistor 50 (50A, 50B) includes a support plate 51, an urging member 52, a film 53, and a temperature detecting element 55. The urging member 52 is a spongy member having elasticity, and the urging member 52 is supported by the support plate 51. The urging member 52 has a D-shape in cross section. The temperature detecting element 55 is disposed so as to be located at a most protruding portion in the urging member 52, and the temperature detecting element 55 is connected to not-illustrated wiring. The film 53 is disposed such that the temperature detecting element 55 is located at the most protruding portion in the urging member 52, and the film 53 is mounted to the support plate 51 so as to be wound around the urging portion 52 and the support plate 51.

As illustrated in FIG. 3A, the film 53 has slits 53X extending in a direction orthogonal to the longitudinal direction at both end portions of the film 53 in the longitudinal direction. Accordingly, the film 53 includes a central portion 53A located at the center of the film 53 in the longitudinal direction and being in contact with the urging portion 52, and protruding portions 53B, each of which is an example of a first protrusion, positioned at both end portions of the film 53 in the longitudinal direction. The protruding portions 53B are portions, as illustrated in FIG. 5A, protruding relatively to the central portion 53A by the urging member 52 which is pushed and deformed when the thermistor 50 is mounted to the holder 20 and is pushed onto the second heat conductive member 45A, 45B. The second heat conductive member 45A, 45B are positioned with respect to the thermistor 50 in a state in which both ends of the second heat conductive member 45A, 45B in the longitudinal direction are engaged with the protruding portions 53B.

Figure 3B:
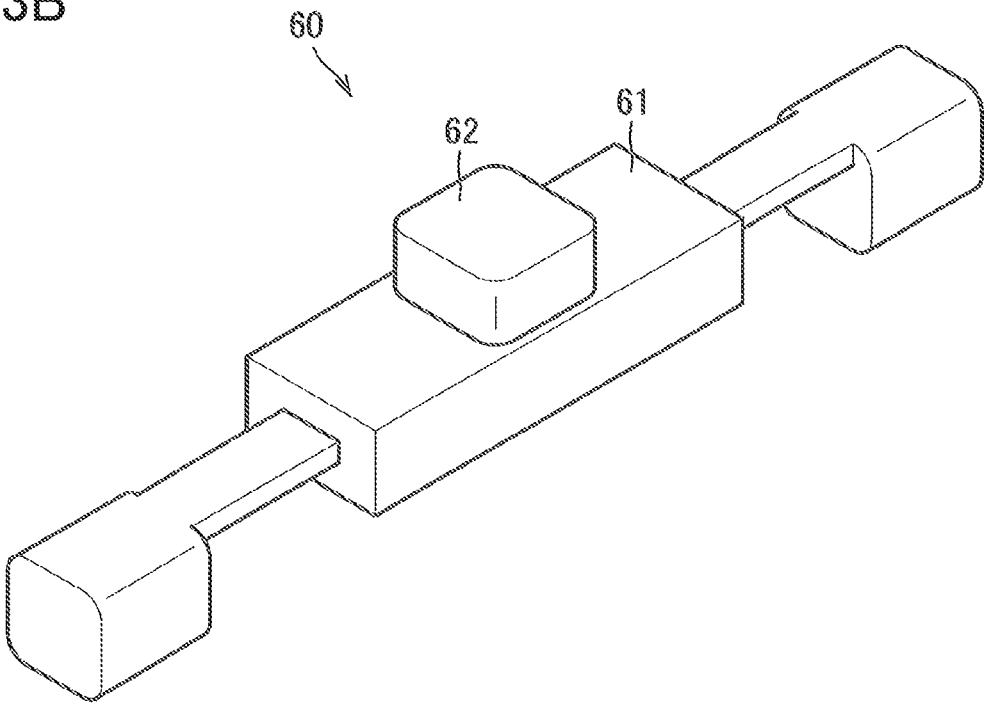
FIG. 3B is a perspective view of an energization interrupting member.

As illustrated in FIG. 3B, the energization interrupting member 60 is a thermostat having an interrupting mechanism formed of bimetal and located inside the thermostat, and the energization interrupting member 60 includes a case 61 accommodating the interrupting mechanism and a detector 62 protruding from the case 61 and configured to detect the temperature. As illustrated in FIG. 5B, the second heat conductive member 46 is positioned with respect to the energization interrupting member 60 in a state in which the protruding portions 46B are engaged with both ends in the longitudinal direction of the detector 62.

As illustrated in FIG. 1, the first thermistor 50A is configured such that a portion protruding from the support plate 51 enters an inside of the holder opening 25A, and the portion protruding from the support plate 51 is in contact with the second opposite surface 45R of the second heat conductive member 45A through the holder opening 25A. The urging member 52 of the first thermistor 50A is pushed and deformed, and the temperature detecting element 55 is pushed onto the second opposite surface 45R of the second heat conductive member 45A. A configuration in which the second thermistor 50B is in contact with the second opposite surface 45R is the same as the configuration in which the first thermistor 50A is in contact with the second opposite surface 45R; therefore, explanation of the second thermistor 50B is dispensed with.

It is preferable that the first openings 35A, 35B become small as long as the second heat conductive members 45A, 45B can be disposed. For example, a size of each of the first openings 35A, 35B in the longitudinal direction is preferably 1.5 times or less of a size of each of the second heat conductive members 45A, 45B in the longitudinal direction. A size of each of the first openings 35A, 35B in the short-side direction is preferably 1.5 times or less of a size of each of the second heat conductive members 45A, 45B in the short-side direction. A size of each of the second heat conductive members 45A, 45B in the planar direction is equivalent to the urging member 52 as an example. It is preferable that a width of each of the second heat conductive members 45A, 45B is larger than a width of one resistance heating element 12 in the short-side direction. It is preferable that the width of each of the second heat conductive members 45A, 45B is larger than a distance of the two adjacent resistance heating elements 12 in the short-side direction.

As illustrated in FIG. 4, the energization interrupting member 60 is configured such that the detector 62 protruding from the case 61 enters the holder opening 26, and the detector 62 is in contact with the second opposite surface 46R of the second heat conductive member 46 through the holder opening 26.

It is preferable that the second opening 36 becomes small as long as the second heat conductive member 46 can be disposed. For example, a size of the second opening 36 in the longitudinal direction is preferably 1.5 times or less of a size of the second heat conductive member 46 in the longitudinal direction. A size of the second opening 36 in the short-side direction is preferably 1.5 times or less of a size of the second heat conductive member 46 in the short-side direction. As an example, a size of the second heat conductive member 46 in the planar direction is equivalent to a size of the detector 62. It is preferable that a width of the second heat conductive member 46 is larger than the width of one resistance heating element 12 in the short-side direction. It is preferable that the width of the second heat conductive member 46 is larger than the distance of the two adjacent resistance heating elements 12 in the short-side direction.

As illustrated in FIG. 2C, the first thermistor 50A is disposed so as to detect the temperature at positions in a range in which a sheet with a minimum width W2 usable in the heating unit 1 can pass. The second thermistor 50B is disposed so as to detect the temperature at a position in a range in which the sheet with a maximum width W1 usable in the heating unit 1 can pass and out of the range in which the sheet with the minimum width W2 usable in the heating unit 1 can pass (a range located on the other-end side of the minimum width W2 in which the second thermistor 50B can be disposed is illustrated in FIG. 2A as an end range AE1). The energization interrupting member 60 is disposed so as to detect the temperature at a position in the range in which the sheet with the maximum width W1 usable in the heating unit 1 can pass and out of the range in which the sheet with the minimum width W2 usable in the heating unit 1 can pass (a range located on one-end side of the minimum width W2 in which the energization interrupting member 60 can be disposed is illustrated in FIG. 2A as an end range AE2).

Then, one ends 12A and the other ends 12B of the resistance heating elements 12 are located on outer sides of the maximum width W1 and on an inner side of one end portion 38A and the other end portion 38B of the first heat conductive member 30 in the longitudinal direction. That is, a length of the first heat conductive member 30 is longer than a length of the resistance heating element 12 in the longitudinal direction.

The one end portion 38A and the other end portion 38B of the first heat conductive member 30 are located on outer sides of the one ends 12A and the other ends 12B of the resistance heating element 12 and on an inner side of one end 11A and the other end 11B of the substrate 11 in the longitudinal direction. That is, a length of the substrate 11 is longer than the length of the first heat conductive member 30 in the longitudinal direction.

Operations and effects of the above heating unit 1 will be explained.

The thermistor 50 is in contact with the second opposite surface 45R of the second heat conductive member 45, and the energization interrupting member 60 is in contact with the second opposite surface 46R of the second heat conductive member 46. The second heat conductive members 45, 46 have better heat conductivity in the thickness direction than the first heat conductive member 30; therefore, the thermistor 50 and the energization interrupting member 60 have good response with respect to the temperature of the heater 10.

On the other hand, if the thermistor 50 and the energization interrupting member 60 are in contact with the back surface 16 of the heater 10 directly, they may be affected by temperature unevenness due to disposition of the resistance heating elements 12. For example, in a case where the thermistor 50 and the energization interrupting member 60 are in contact with portions each corresponding to a portion located between the adjacent two resistance heating elements 12 in the short-side direction on the back surface 16, it may be difficult to detect an accurate temperature. However, the thermistor 50 and the energization interrupting member 60 are in contact with the second opposite surfaces 45R, 46R of the second heat conductive members 45, 46 which are different members from the first heat conductive member 30 without directly being in contact with the back surface 16 of the heater 10 in the embodiment; therefore, temperature unevenness due to disposition of the resistance heating elements 12 can be uniformed by the second heat conductive members 45, 46. Accordingly, it is possible to detect the accurate temperature by the thermistor 50 and the energization interrupting member 60.

The end ranges AE1, AE2 are portions in which the temperatures of the end ranges AE1, AE2 are easily increased since heat is not deprived by the sheet with the minimum width W2 when the sheet with the minimum width W2 is heated. When the temperatures at the end ranges AE1, AE2 are increased, heat of the heater 10 is transmitted through the first heat conductive member 30 and the second heat conductive members 45B, 46 and flows from the end ranges AE1, AE2 to the range inside the minimum width W2. Here, if the second heat conductive members 45B, 46 do not exist, heat does not flow in the longitudinal direction from the end ranges AE1, AE2 to the range inside the minimum width W2, however, since the second heat conductive members 45B, 46 are provided in the embodiment, heat conduction performance at the end ranges AE1, AE2 is not largely affected. Accordingly, it is possible to suppress temperature increase at end portions in the longitudinal direction of the heater 10.

Since the heat conductivity from the heater 10 to the second opposite surface 46R is better than the heat conductivity from the heater 10 to the first opposite surface 32, it is possible to detect the accurate temperature by the thermistor 50 and the energization interrupting member 60 while securing response of the thermistor 50 and the energization interrupting member 60 with respect to the temperature of the heater 10.

Since the length of the first heat conductive member 30 is longer than the length of the resistance heating element 12, it is possible to uniform the temperature of the heater 10 in the entire range in which the resistance heating elements 12 are disposed in the longitudinal direction of the heater 10.

Since the second thermistor 50B is disposed so as to detect the temperature at a position in the end range AE1, it is possible to detect temperature increase in the end range AE1 by the second thermistor 50B.

Since the energization interrupting member 60 is disposed so as to detect the temperature at the position in the end range AE2, it is possible to detect temperature increase in the range AE2 by the energization interrupting member 60.

Since the second heat conductive member 45 is engaged with the protruding portions 53B of the thermistor 50, it is possible to be properly positioned the second heat conductive member 45 with respect to the thermistor 50.

Since the protruding portions 46B of the second heat conductive member 46 are engaged with the energization interrupting member 60, it is possible to be properly positioned the second heat conductive member 46 with respect to the energization interrupting member 60. It is preferable that a thickness of the energization interrupting member 60 is 0.03 mm to 3 mm.

The embodiment of the present disclosure has been explained above. The present disclosure is not limited to the above embodiment and can be achieved by being modified suitably.

Figure 6:
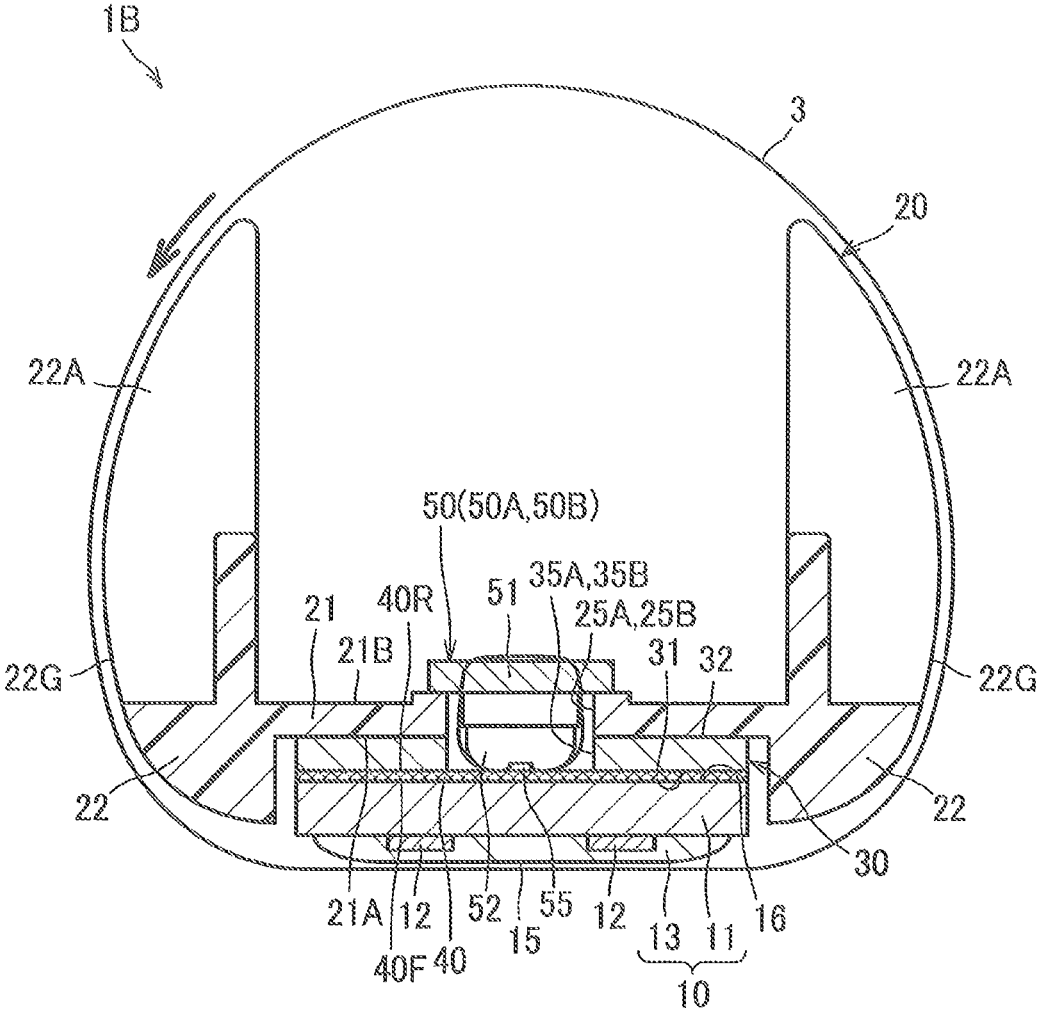
FIG. 6 is a cross-sectional view of a heating unit in a case where the second heat conductive member is larger than an opening.

For example, a second heat conductive member 40 may be larger than the openings (the first openings 35A, 35B) of the first heat conductive member 30 as in a heating unit 1B illustrated in FIG. 6. In this modification, the second heat conductive member 40 has the same size as the first heat conductive member 30 or larger than the first heat conductive member 30 in the longitudinal direction, and has a size equivalent to the first heat conductive member 30 in the short-side direction. In the second heat conductive member 40, a second heater-side surface 40F is in contact with the back surface 16 of the heater 10, and the first heater-side surface 31 of the first heat conductive member 30 is in contact with a second opposite surface 40R. Also in this modification, the second heat conductive member 40 is located at positions corresponding to the first openings 35A, 35B and temperature sensors (the thermistor 50 and the like) are in contact with the second opposite surface 40R; therefore, the same advantages as the above embodiment can be obtained.

Also in this modification, the graphite sheet which is the anisotropic heat conductive member can be adopted as the second heat conductive member 40 as an example.

Figure 7:
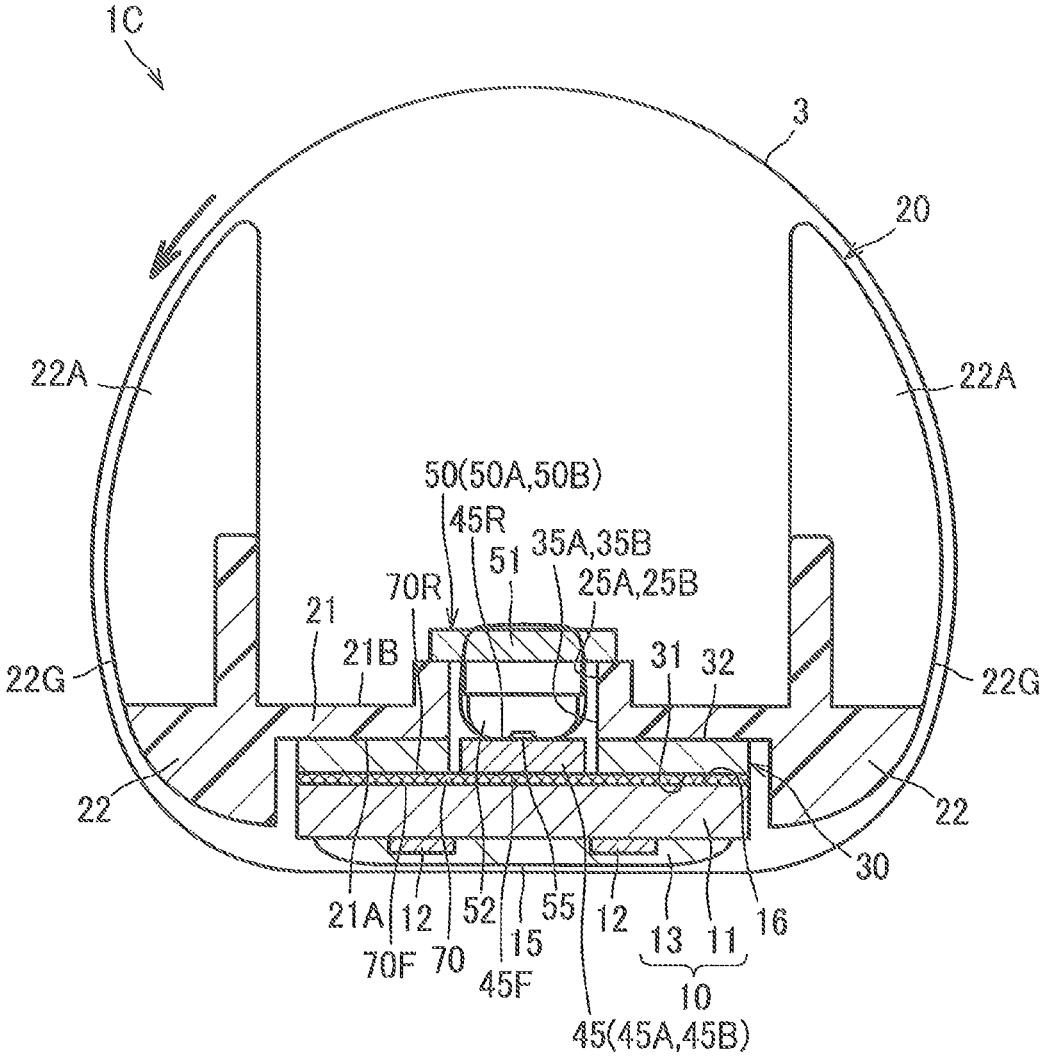
FIG. 7 is a cross-sectional view of a heating unit in a case where the heating unit includes a third heat conductive member.

A sheet-like third heat conductive member 70 may be further provided between the heater 10 and the first heat conductive member 30 and between the heater 10 and the second heat conductive member 45 as in a heating unit 1C illustrated in FIG. 7. The third heat conductive member 70 includes a third heater-side surface 70F which is in contact with the back surface 16 of the heater 10 and a third opposite surface 70R located on an opposite side of the third heater-side surface 70F. Then, the first heater-side surface 31 is in contact with the third opposite surface 70R of the first heat conductive member 30, and the second heater-side surface 45F is in contact with the third opposite surface 70R of the second heat conductive member 45.

The third heat conductive member 70 is, for example, an anisotropic heat conductive member in which a heat conductivity in a direction parallel to the third heater-side surface 70F is higher than a heat conductivity in a direction orthogonal to the third heater-side surface 70F, and the third heat conductive member is the graphite sheet as an example.

A method for positioning the second heat conductive member may be different from one in the above embodiment.

Figure 9A:
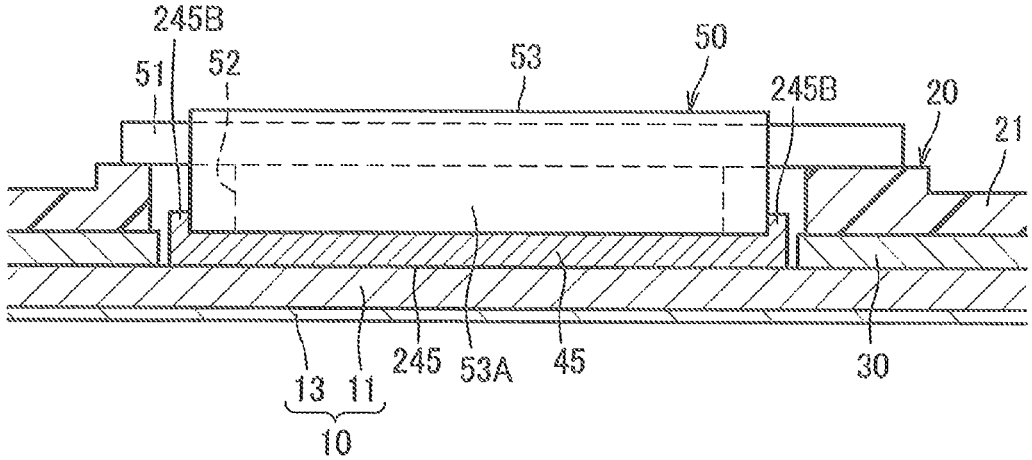
FIG. 9A is a cross-sectional view of a heating unit along the longitudinal direction for explaining another modification of positioning of the second heat conductive member and the thermistor.

For example, instead of the protruding portions of the thermistor 50, a second heat conductive member 245 may have protruding portions 245B, each of which is an example of a second protrusion, at both ends in the longitudinal direction of the second heat conductive member 245, and the protruding portions 245B may be engaged with both end portions of the film 53 in the thermistor 50 as illustrated in FIG. 9A.

Figure 9B:
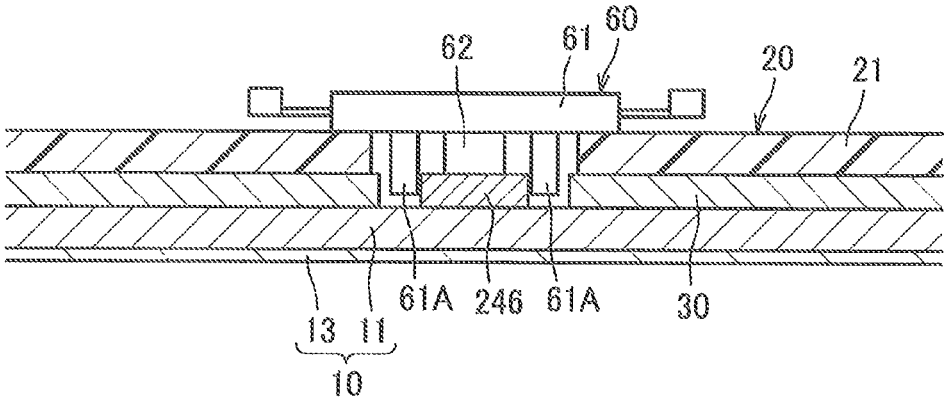
FIG. 9B is a cross-sectional view of a heating unit along the longitudinal direction for explaining another modification of positioning of the second heat conductive member and the energization interrupting member.

Instead of the protruding of the second heat conductive member, the energization interrupting member 60 may have protruding portions 61A at both ends in the longitudinal direction of the energization interrupting member 60, and the protruding portions 61A may be engaged with both end portions of a second heat conductive member 246 as illustrated in FIG. 9B.

Figure 9C:
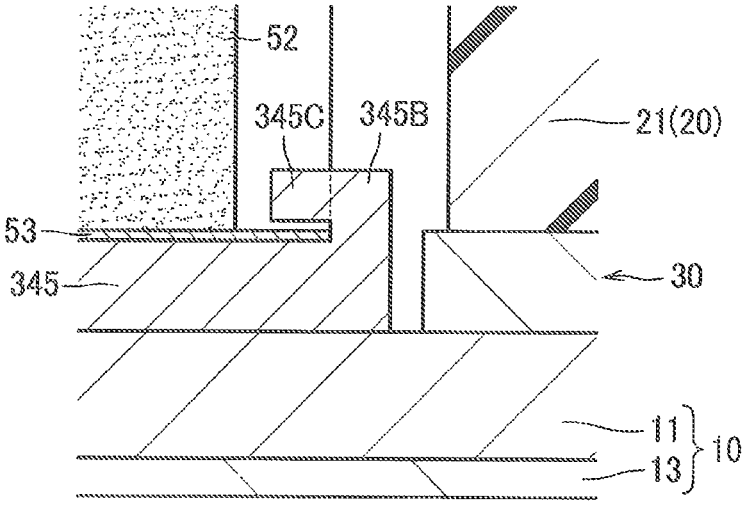
FIG. 9C is an enlarged cross-sectional view of a heating unit along the longitudinal direction for explaining further another modification of the second heat conductive member and the thermistor.

Not only the second heat conductive member 245 has the protruding portions 245B protruding toward the thermistor 50 as in the modification illustrated in FIG. 9A but also a second heat conductive member 345 may have locking members 345C protruding from protruding portions 345B, each of which is an example of a second protrusion, toward an inner side in the longitudinal direction in addition to protruding portions 345B protruding toward the thermistor 50 as in a modification illustrated in FIG. 9C. When the locking members 345C are engaged with the film 53, it is possible to prevent the second heat conductive member 345 from coming off unnecessarily after the film 53 is mounted to the second heat conductive member 345.

Figure 10A:
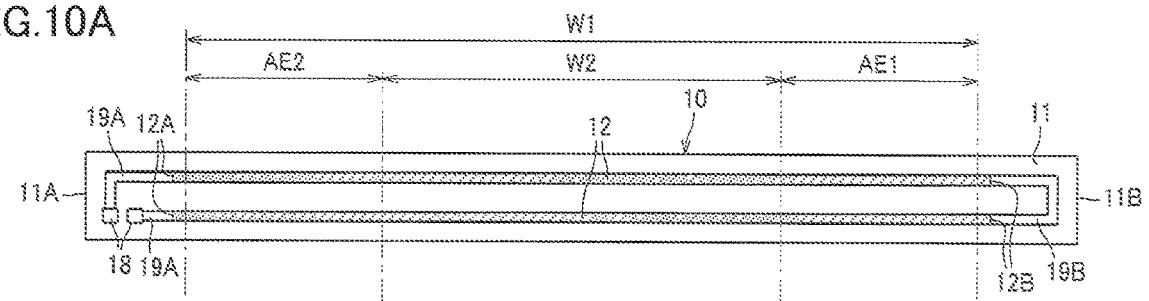
FIG. 10A is a view illustrating a surface on which resistance heating elements of the heater are disposed according to a modification example.
Figure 10B:
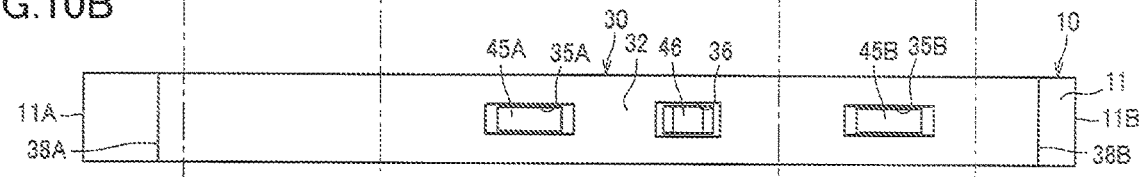
FIG. 10B is a view of the heater, the first heat conductive member, and the second heat conductive members viewed from the back side of the heater.
Figure 10C:
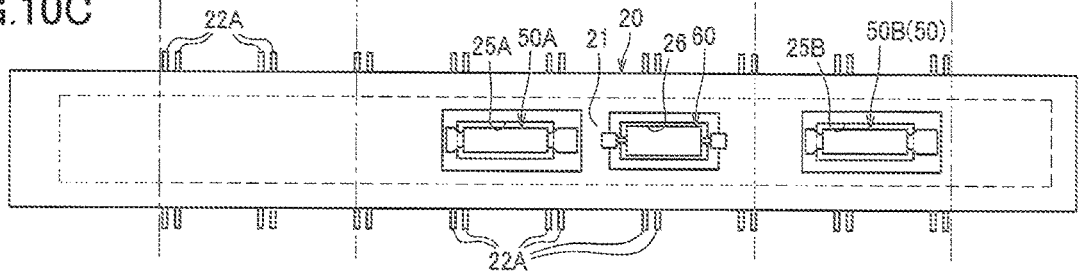
FIG. 10C is a view of the holder viewed from the opposite side of the heater.

Moreover, the energization interrupting member 60 may be disposed so as to detect the temperature at a position in the range in which the sheet with the minimum width W2 usable in the heating unit 1 can pass as in a modification illustrated in FIG. 10C. Also in this case, it is possible to detect the accurate temperature by the thermistor 50 and the energization interrupting member 60. The energization interrupting member 60 is disposed at the position in the range in which the sheet with the minimum width W2 usable in the heating unit 1 can pass; therefore, it is possible to detect abnormal temperature increase of the heater 10 regardless of the size of the sheet in the width direction.

The numbers of the temperature sensors and the energization interrupting members are not limited. Only one temperature sensor may be provided and three or more temperature sensors may be provided. Two or more energization interrupting members may be provided and it is possible that no energization interrupting member is provided. Only the first thermistor 50A may be in contact with the second opposite surface 45R of the second heat conductive member 45. For example, the second thermistor 50B and the energization interrupting member 60 may be in contact with the first opposite surface 32 of the first heat conductive member 30 or the back surface 16 of the heater 10.

In the above embodiment, each of the first heat conductive member 30, the second heat conductive members 45, 46, and the third heat conductive member 70 is formed of one sheet-like member; however, each of them may be formed of a combination of a plurality of sheet-like members. In the latter case, the material, heat conductivity, and the shape of the plurality of sheet-like members may be different from one another and may be the same as one another.

In the above embodiment, the substrate 11 of the heater 10 is formed of the long rectangular plate made of ceramic; however, the substrate 11 may be formed of a long rectangular plate made of metal such as stainless steel, which has a heat conductivity lower than that of the heat conductive member 30.

In the above embodiment, the opening is a through hole formed at a position apart from an outline of the heat conductive member; however, the opening may have a cutout shape.

Respective components explained in the above embodiment and modification examples may be arbitrarily combined to achieve the disclosure.

What is claimed is:

1. A heating unit, comprising:

a heater including a substrate and a resistance heating element provided on the substrate;

a temperature sensor configured to detect a temperature of the heater;

an endless belt configured to rotate around the heater;

a holder supporting the heater;

a first heat conductive member located between the heater and the holder, the first heat conductive member including a first heater-side surface facing the heater, a first opposite surface located on an opposite side of the first heater-side surface, and an opening, the first heat conductive member having a heat conductivity higher than that of the substrate; and a second heat conductive member disposed at a position at least corresponding to the opening when viewed in an orthogonal direction orthogonal to the first opposite surface, the second heat conductive member including a second heater-side surface facing the heater and a second opposite surface located on an opposite side of the second heater-side surface, wherein the temperature sensor is in contact with the second opposite surface of the second heat conductive member, and wherein the second heat conductive member is located inside the opening of the first heat conductive member.

2. The heating unit according to claim 1, wherein a heat conductivity of the second heat conductive member is higher than the heat conductivity of the first heat conductive member.

3. The heating unit according to claim 1, wherein a thickness of the second heat conductive member is smaller than a thickness of the first heat conductive member.

4. The heating unit according to claim 1, wherein the first heater-side surface of the first heat conductive member is in contact with the second opposite surface, and wherein the second heater-side surface of the second heat conductive member is in contact with the heater.

5. The heating unit according to claim 1, wherein a length of the first heat conductive member in a longitudinal direction of the heater is longer than a length of the resistance heating element.

6. The heating unit according to claim 1, wherein the temperature sensor is configured to detect the temperature at the position, in the longitudinal direction of the heater, in a range in which a recording medium with a maximum width usable in the heating unit passes and out of a range in which a recording medium with a minimum width usable in the heating unit passes.

7. The heating unit according to claim 1, wherein the first heat conductive member is made of aluminum or an aluminum alloy.

8. The heating unit according to claim 1, wherein the first heat conductive member is an anisotropic heat conductive member in which a heat conductivity in a direction parallel to the first heater-side surface is higher than a heat conductivity in the direction orthogonal to the first heater-side surface.

9. The heating unit according to claim 8, wherein the anisotropic heat conductive member is a graphite sheet.

10. The heating unit according to claim 1, further comprising a third heat conductive member including a third heater-side surface which is in contact with the heater and a third opposite surface located on an opposite side of the third heater-side surface, wherein the first heater-side surface of the first heat conductive member is in contact with the third opposite surface, and wherein the second heater-side surface of the second heat conductive member is in contact with the third opposite surface.

11. The heating unit according to claim 10, wherein the third heat conductive member is an anisotropic heat conductive member in which a heat conductivity in a direction parallel to the third heater-side surface is higher than a heat conductivity in a direction orthogonal to the third heater-side surface.

12. The heating unit according to claim 11, wherein the anisotropic heat conductive member is a graphite sheet.

13. The heating unit according to claim 1, wherein the second heat conductive member is made of aluminum or an aluminum alloy.

14. The heating unit according to claim 1, wherein the temperature sensor includes a first protrusion, and wherein the second heat conductive member is engaging with the first protrusion.

15. The heating unit according to claim 1, wherein the second heat conductive member includes a second protrusion, and wherein the second protrusion engages with the temperature sensor.

16. The heating unit according to claim 1, wherein the temperature sensor is a thermistor, or a thermostat configured to interrupt energization to the resistance heating element when the heater is abnormally increased in temperature.

17. A heating unit, comprising:

a heater including a substrate and a resistance heating element provided on the substrate:

a temperature sensor configured to detect a temperature of the heater;

an endless belt configured to rotate around the heater;

a holder supporting the heater;

a first heat conductive member located between the heater and the holder, the first heat conductive member including a first heater-side surface facing the heater, a first opposite surface located on an opposite side of the first heater-side surface, and an opening, the first heat conductive member having a heat conductivity higher than that of the substrate; and a second heat conductive member disposed at a position at least corresponding to the opening when viewed in an orthogonal direction orthogonal to the first opposite surface, the second heat conductive member including a second heater-side surface facing the heater and a second opposite surface located on an opposite side of the second heater-side surface, wherein the temperature sensor in contact with the second opposite surface of the second heat conductive member, and wherein a heat conductivity from the heater to the second opposite surface of the second heat conductive member is higher than a heat conductivity from the heater to the first opposite surface of the first heat conductive member.

18. A heating unit, comprising:

a heater including a substrate and a resistance heating element provided on the substrate;

a temperature sensor configured to detect a temperature of the heater;

an endless belt configured to rotate around the heater;

a holder supporting the heater;

a first heat conductive member located between the heater and the holder, the first heat conductive member including a first heater-side surface facing the heater, a first opposite surface located on an opposite side of the first heater-side surface, and an opening, the first heat conductive member having a heat conductivity higher than that of the substrate; and a second heat conductive member disposed at a position at least corresponding to the opening when viewed in an orthogonal direction orthogonal to the first opposite surface, the second heat conductive member including a second heater-side surface facing the heater and a second opposite surface located on an opposite side of the second heater-side surface, wherein the temperature sensor is in contact with the second opposite surface of the second heat conductive member, and wherein a size of the second heat conductive member is smaller than that of the first heat conductive member when viewed in the orthogonal direction.

19. The heating unit according to claim 18, wherein the second heat conductive member is located inside the opening.

20. The heating unit according to claim 19, wherein the first heater-side surface of the first heat conductive member is in contact with the heater, and wherein the second heater-side surface of the second heat conductive member is in contact with the heater.

* * * * *